US011072491B1

(12) United States Patent
Van Tassell et al.

(10) Patent No.: US 11,072,491 B1
(45) Date of Patent: Jul. 27, 2021

(54) GARBAGE BAG HOLDER

(71) Applicant: Vantage Innovative Products LLC, Paul, ID (US)

(72) Inventors: Marty Van Tassell, Paul, ID (US); Tonya Van Tassell, Paul, ID (US)

(73) Assignee: Vantage Innovative Products LLC, Paul, ID (US)

( * ) Notice: Subject to any disclaimer, the term of this patent is extended or adjusted under 35 U.S.C. 154(b) by 0 days.

(21) Appl. No.: 16/735,914

(22) Filed: Jan. 7, 2020

(51) Int. Cl.
*B65F 1/14* (2006.01)
*B65B 67/12* (2006.01)

(52) U.S. Cl.
CPC ..... *B65F 1/1415* (2013.01); *B65B 67/1205* (2013.01)

(58) Field of Classification Search
CPC ..... B65F 1/1415; B65B 67/1205
See application file for complete search history.

(56) References Cited

U.S. PATENT DOCUMENTS 447,686 A * 3/1891 Holladay ..... B65B 67/12 248/97
D216,438 S * 1/1970 Bexley et al. ..... B65B 67/1205 D34/6
3,638,888 A * 2/1972 Ross ..... B65B 67/1205 248/97
3,768,763 A * 10/1973 Hembree ..... B65B 67/12 248/97
4,174,085 A * 11/1979 Ferreira ..... B65B 67/1205 108/11
4,304,378 A * 12/1981 Briggs ..... B65B 67/1255 248/150
4,927,104 A * 5/1990 Miller ..... B65B 67/1205 248/150
5,435,620 A * 7/1995 Cheng ..... A47C 4/20 108/132
5,852,250 A * 12/1998 Cha ..... G10G 5/00 84/327
6,382,573 B1 * 5/2002 Cepeda ..... B65B 67/1205 248/150
D907,319 S * 1/2021 Van Tassell ..... A47C 4/20 D34/6

* cited by examiner

*Primary Examiner* — Anita M King
(74) *Attorney, Agent, or Firm* — Kirton Mcconkie; Brian Tucker

(57) ABSTRACT

A garbage bag holder can be used in place of a traditional garbage can. The garbage bag holder can have a foldable design that facilitates its transport and enables it to be easily deployed in virtually any location. At the same time, the foldable design provides a reinforced structure that allows the garbage bag holder to support a substantial amount of weight.

20 Claims, 5 Drawing Sheets

GARBAGE BAG HOLDER

CROSS-REFERENCE TO RELATED APPLICATIONS

N/A

BACKGROUND

Garbage bags are typically placed in garbage cans that are round, square or rectangular in shape. Garbage cans are relatively bulky and consume significant space. It is therefore difficult to transport garbage cans such as to a camp site, tailgating event or any other location where garbage may be produced. For this reason, it is common to simply employ a garbage bag without a garbage can. Yet, this creates additional difficulties. For example, if a garbage bag is placed on the ground or other surface, individuals will have to open the garbage bag to place garbage within it. Alternatively, individuals may attempt to secure the garbage bag from some structure to cause it to hang open. However, this oftentimes leads to the garbage bag falling and possibly spilling the garbage. Additionally, whenever a garbage bag is used independent of a garbage bag, it is much more likely that the garbage bag will rip.

The subject matter claimed herein is not limited to embodiments that solve any disadvantages or that operate only in environments such as those described above. Rather, this background is only provided to illustrate one example technology area where some implementations described herein may be practiced.

BRIEF SUMMARY

The present invention extends to a garbage bag holder that can be used in place of a traditional garbage can. The garbage bag holder can have a foldable design that facilitates its transport and enables it to be easily deployed in virtually any location. At the same time, the foldable design provides a reinforced structure that allows the garbage bag holder to support a substantial amount of weight.

In some embodiments, a garbage bag holder includes opposing vertical support members, an upper support member and a base member. The upper support member is connected to top ends of the vertical support members and pivots relative to the vertical support members between an extended position and a retracted position. The base member is connected to bottoms ends of the vertical support members and pivots relative to the vertical support members between an extended position and a retracted position.

In some embodiments, a garbage bag holder includes opposing vertical support members, an upper support member and a base member. The upper support member has opposing side portions and a front portion that extends between a front end of the opposing side portions of the upper support member. Rear ends of the opposing side portions of the upper support member are connected to top ends of the vertical support members. The upper support member pivots relative to the vertical support members between an extended position and a retracted position. The base member has opposing side portions and a front portion that extends between a front end of the opposing side portions of the base member. Rear ends of the opposing side portions of the base member are connected to bottoms ends of the vertical support members. The base member pivots relative to the vertical support members between an extended position and a retracted position.

In some embodiments, a garbage bag holder includes opposing vertical support members, an upper support member and a base member. The upper support member is connected to top ends of the vertical support members and pivots relative to the vertical support members between an extended position and a retracted position. The base member is connected to bottoms ends of the vertical support members and pivots relative to the vertical support members between an extended position and a retracted position. When the upper support member and the base member are in the extended position, the upper support member and the base member extend perpendicular to the vertical support members, whereas, when the upper support member and the base member are in the retracted position, the upper support member and the base member extend parallel to the vertical support members.

It is to be understood that both the foregoing general description and the following detailed description are exemplary and explanatory and are not restrictive of the invention, as claimed. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The following detailed description is, therefore, not to be taken in a limiting sense.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1A:
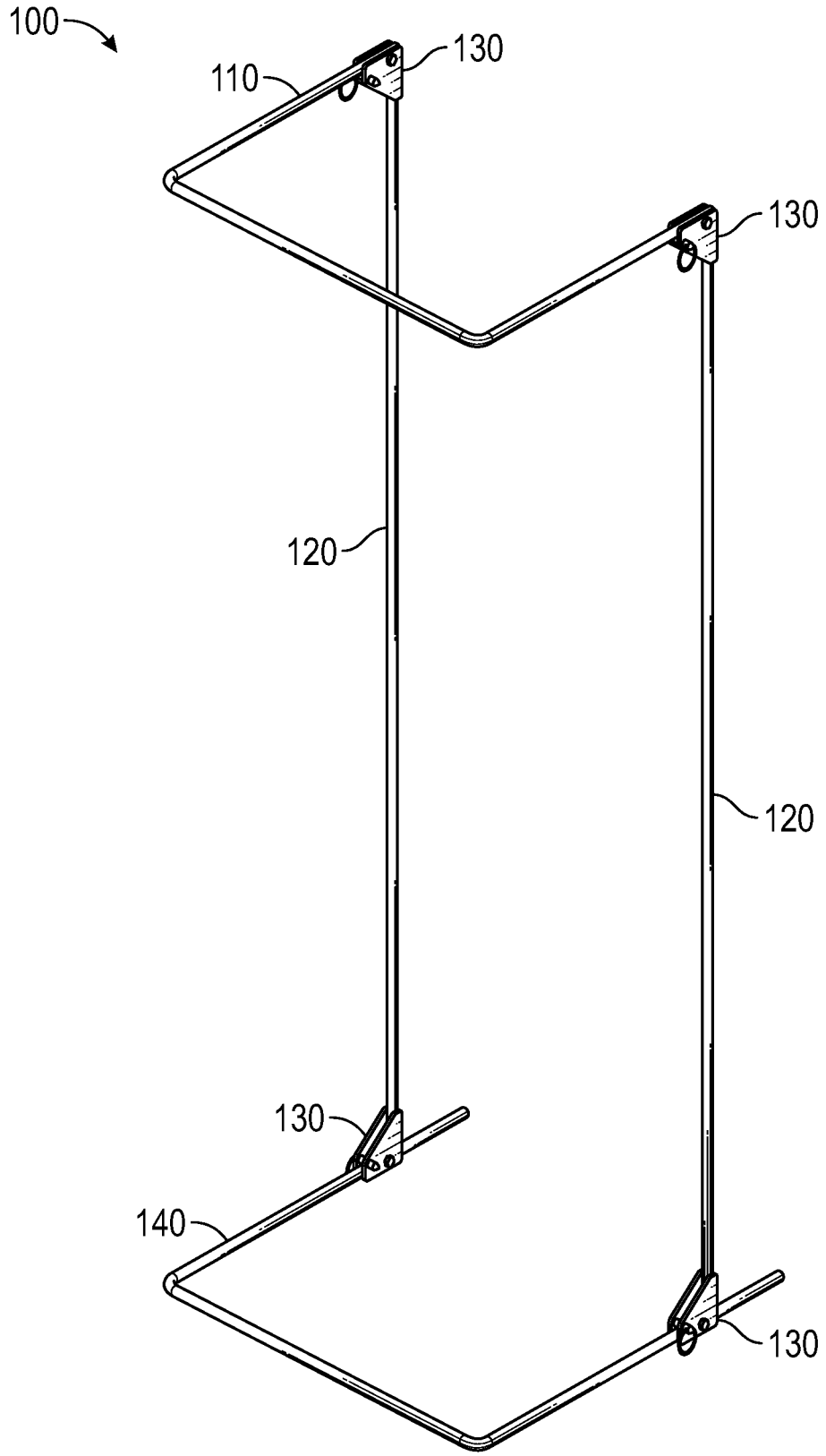
FIG. 1A illustrates an example of a garbage bag holder that is configured in accordance with embodiments of the present invention.
Figure 1B:
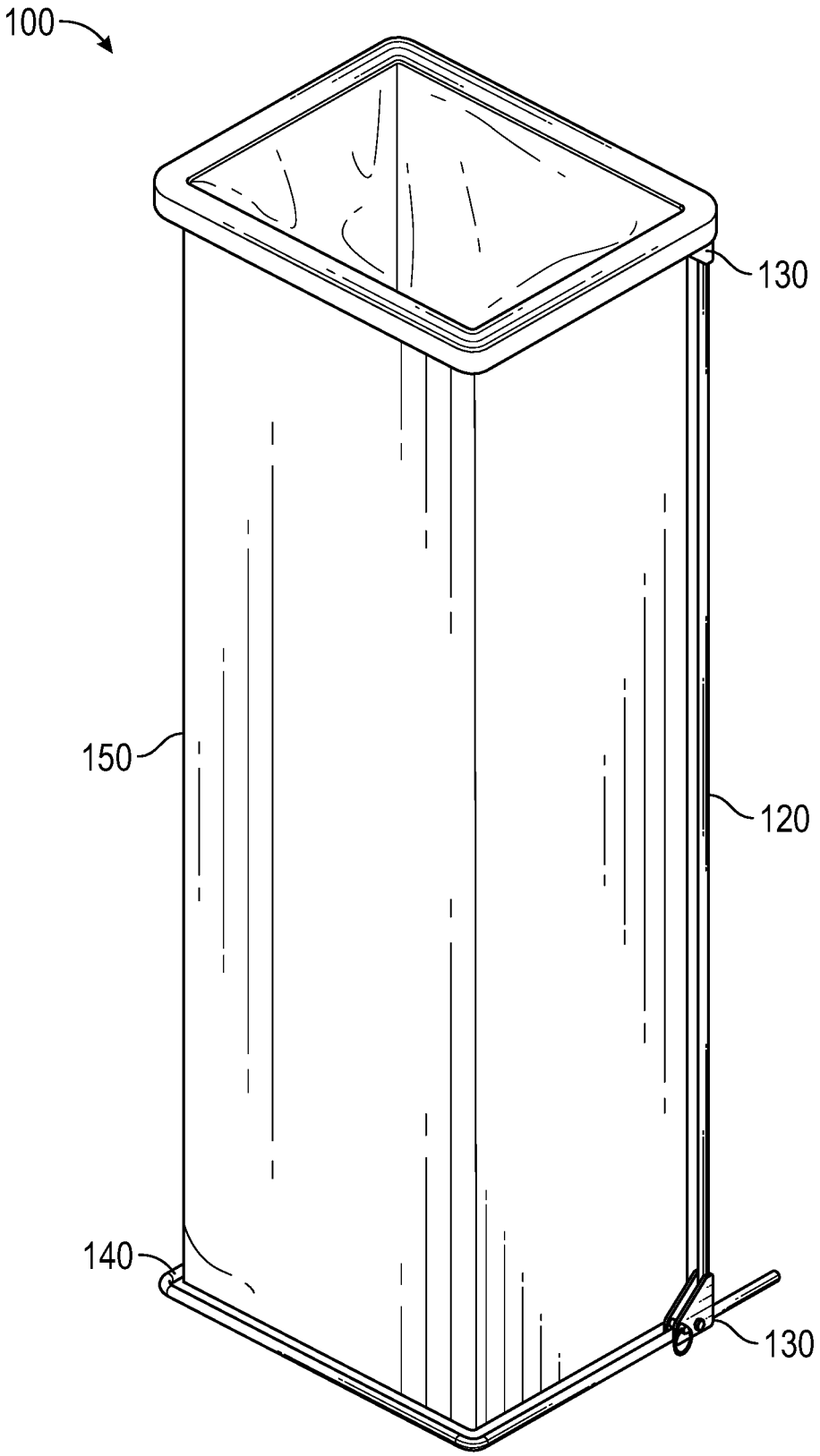
FIG. 1B illustrates the garbage bag holder when it supports a garbage bag.

FIG. 1A illustrates an embodiment of a garbage bag holder 100 when it is in an extended position (i.e., when it is in the position in which it supports a garbage bag), while FIG. 1B illustrates how garbage bag holder 100 can support a garbage bag 150. As shown, garbage bag holder 100 includes an upper support member 110, opposing vertical support members 120, coupling members 130 and a base member 140. Upper support member 110 may have a generally U-shape with its ends being secured to the top of opposing vertical support members 120 via coupling members 130. When in the depicted position, upper support member 110 will be referred to as extending frontwardly from opposing vertical support members 120.

Base member 140 may also have a generally U-shape and may be secured to the bottom of opposing vertical support members 120 via coupling members 130 such that, like upper support member 110, base member 140 extends frontwardly from opposing vertical support members 120. However, unlike the ends of upper support member 110, the ends of base member 140 may extend rearwardly beyond opposing vertical support members 120.

Figure 2:
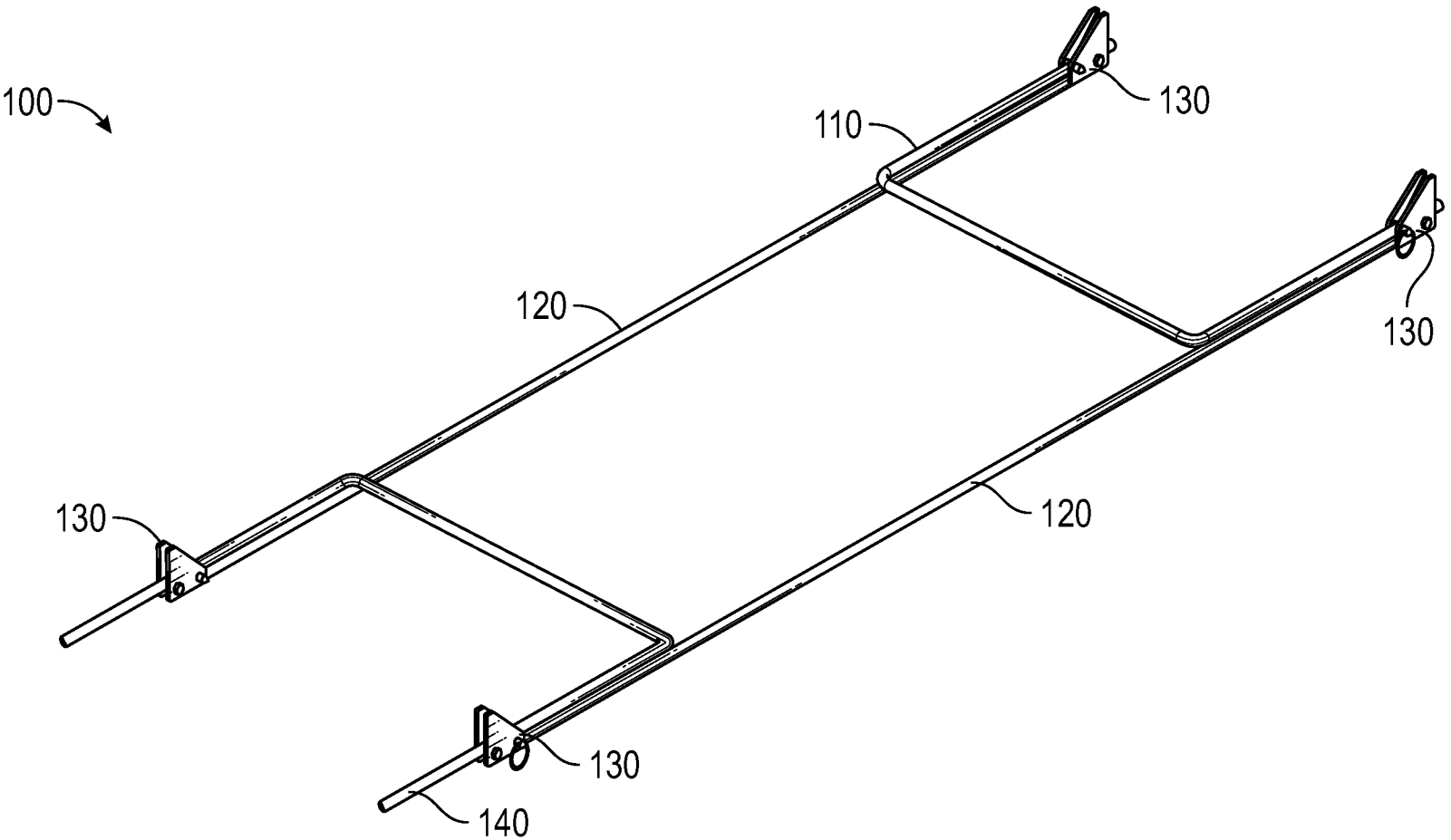
FIG. 2 illustrates the garbage bag holder when retracted.

FIG. 2 illustrates garbage bag holder 100 when in the retracted position. As shown, coupling members 130 are configured to allow upper support member 110 to be folded downwardly against opposing vertical support members 120 and to allow base member 140 to be folded upwardly against opposing vertical support members 120. When in this retracted position, garbage bag holder 100 will lie substantially flat to facilitate its transport or storage.

Figure 3:
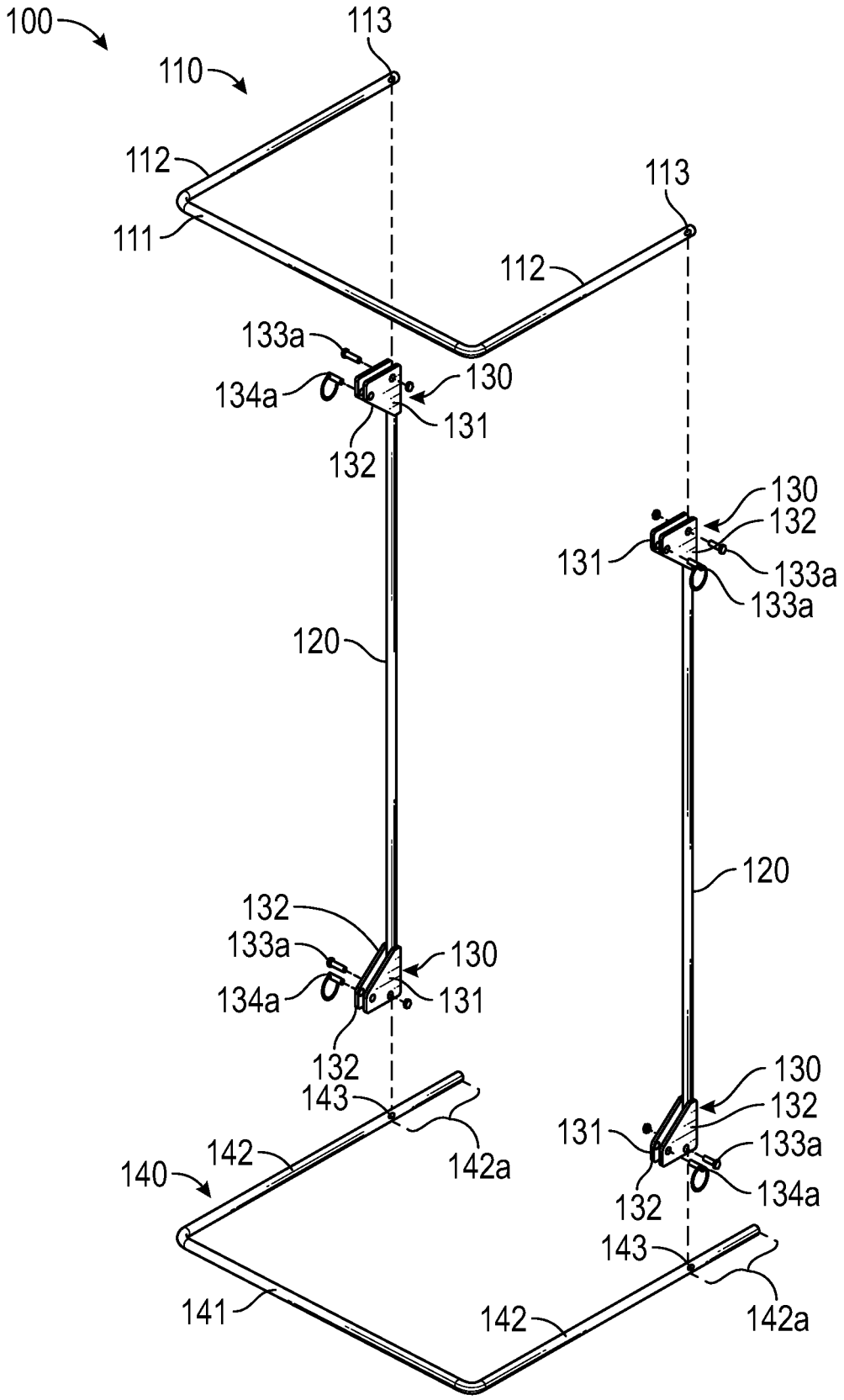
FIG. 3 provides an exploded view of the garbage bag holder.

FIG. 3 illustrates an exploded view of garbage bag holder 100 and provides more detail regarding the foldable design. Upper support member 110 includes a front portion 111 and opposing side portions 112 that extend rearwardly from front portion 111. A hole 113 can be formed towards the rear end of each side portion 112. Similarly, base member 140 includes a front portion 141 and opposing side portions 142 that extend rearwardly from front portion 141. A hole 143 can be formed in each side portion 142 and is spaced frontwardly from the rear end of the side portion 142 thereby creating an extension 142*a* between hole 143 and the rear end of side portion 142.

A coupling member 130 may be affixed at each end of each vertical support member 120. Each coupling member 130 may comprise an inner plate 131 that is affixed to an inner surface of vertical support member 120 and an outer plate 132 that is affixed to an outer surface of vertical support member 120. Each inner plate 131 may be aligned with and spaced from the corresponding outer plate 132 to thereby create a slot or gap therebetween. Each inner plate 131 and outer plate 132 of the coupling members 130 attached at the top ends of vertical support members 120 (or the top coupling members 130) may have a horizontal top edge and a vertical rear edge. Similarly, each inner plate 131 and outer plate 132 of the coupling members 130 attached at the bottom ends of vertical support members 120 (or the bottom coupling members 130) may have a horizontal bottom edge and a vertical rear edge. Each inner plate 131 and outer plate 132 may be affixed to the corresponding vertical support member 120 to align their rear edges with the rear extent of vertical support members 120. The horizontal top edges of the respective inner plates 131 and outer plates 132 may align with the top extent of upper support member 110 when it is in the extended position. The horizontal bottom edges of the respective inner plates 131 and outer plates 132 may align with the bottom extent of base member 140 when it is in the extended position.

Figure 4:
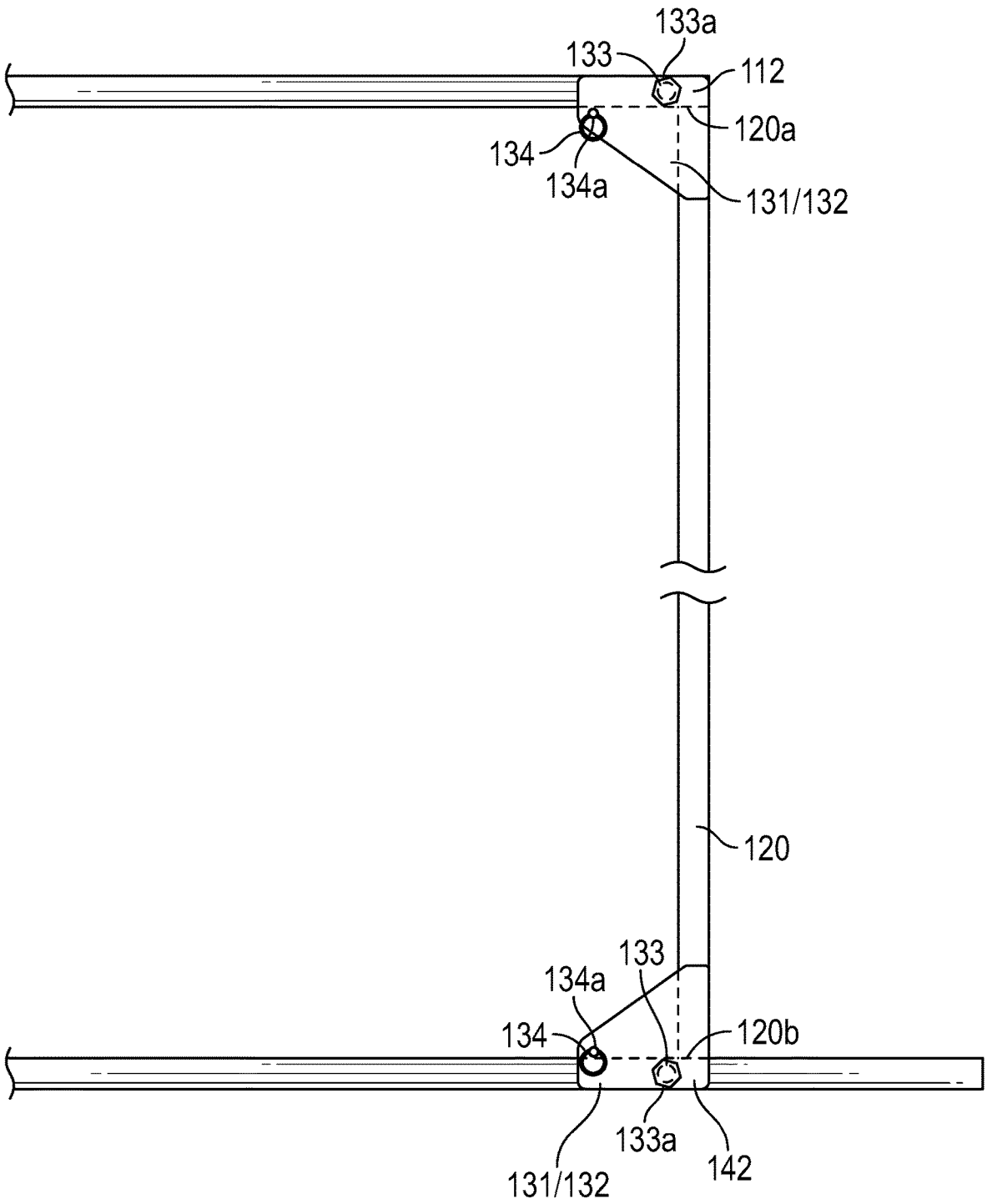
FIG. 4 provides a side view of the garbage bag holder that illustrates its foldable design.

As labeled in FIG. 4, a pivoting hole 133 may be formed in each inner plate 131 and outer plate 132 and may be aligned with the corresponding hole 113/143 to enable a pin 133*a*/134*a* to be inserted therethrough to secure upper support member 110/base member 140 to opposing vertical support members 120. In this context, the term "pin" should be construed as encompassing a bolt, a screw, a rivet, a rod or any other coupler that would allow upper support member 110/base member 140 to pivot relative to opposing vertical support members 120. Each pivoting hole 133 can be positioned relative to the corresponding vertical support member 120 to cause upper support member 120 or base member 140 to align vertically with and against the vertical support member. In other words, the positions of pivoting holes 133 cause upper support member 120 and base member 140 to lie flat against opposing vertical support members 120 when garbage bag holder 100 is in the retracted position. These positions can also cause upper support member 120 and base member 140 to align with the horizontal top and bottom edges of inner and outer plates 131/132 as described above.

A retaining hole 134 may also be formed in each inner plate 131 and outer plate 132 and may be aligned to enable a retaining pin 134*a* to be selectively inserted therethrough. As best illustrated in FIG. 4, retaining holes 134 can be positioned relative to pivoting holes 133 so that retaining pins 134*a* will be positioned against upper support member 120 or base member 140 when these members are in an extended position. More particularly, when upper support member 120 is extended into the horizontal orientation shown in FIG. 4, retaining pins 134*a* will be positioned below but against side portions 112 to thereby prevent upper support arm 120 from pivoting downwardly. In other words, upper support member 110 may rest on pins 134*a* when in the extended position. Similarly, when base member 140 is extended into the horizontal position shown in FIG. 4, retaining pins 134*a* will be positioned above but against (or adjacent to) side portions 142 to thereby prevent base member 140 from pivoting upwardly (or to prevent opposing vertical support members 120 from pivoting downwardly).

FIG. 4 also shows that a top end 120*a* of each vertical support member 120 is spaced from the horizontal top edge of the respective inner and outer plates 131/132 by a distance that is substantially equal to the diameter (or height) of side portions 112. Accordingly, when upper support member 120 is extended fully, it will contact top end 120*a* and be prevented from overextending. A bottom end 120*b* of each vertical support member 120 is spaced in a similar manner so that, when base member 140 is fully extended, it will contact bottom end 120*b* and be prevented from overextending.

FIG. 4 also illustrates that side portions 112 may be configured to align with the rear edges of the respective inner and outer plates 131/132 when upper support member 120 is in the extended position. In other embodiments, however, side portions 112 may not extend to or may extend beyond the rear edges. As introduced above, side portions 142 are configured to extend beyond the rear edges of the respective inner and outer plates 131/132 to form extensions 142*a*. Extensions 142*a* provide added stability and prevent garbage bag holder 100 from tipping over rearwardly. Although not shown, in some embodiments, base member 140 may include a rear portion that extends between the rear ends of side portions 142. Also, in some embodiments, upper support member 110 may include a rear portion that extends between the rear ends of side portions 112. In such cases, the rear ends of side portions 112 may extend beyond the vertical rear edges of the respective inner and outer plates 131/132.

The design of garbage bag holder 100 provides a reinforced, yet foldable structure that enables a large amount of garbage to be placed in a garbage bag. The open design of garbage bag holder 100 enables the garbage bag to expand in each direction. In some embodiments, a customized garbage bag can be provided for use with garbage bag holder 100. This customized garbage bag can be made of a thicker material such as 3 mil plastic sheeting that is shaped to match the dimensions of garbage bag holder 100. By employing a garbage bag with thicker material, the dimensions of garbage bag holder 100 can be increased to accommodate very large garbage bags and substantial amounts of garbage without the fear of ripping. Garbage bag holder 100 can therefore be an ideal solution for an event where it is necessary to transport garbage bag holder 100 (e.g., when camping) and where a large amount of garbage will need to be retained for subsequent disposal.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present inventions have been described in detail, it should be understood that the various changes, substitutions, and alterations could be made hereto without departing from the spirit and scope of the invention.

What is claimed:

1. A garbage bag holder comprising:

opposing vertical support members;

an upper support member that is connected to top ends of the vertical support members, the upper support member pivoting relative to the vertical support members between an extended position and a retracted position, wherein the upper support member comprises opposing side portions each of which includes a rear end that is connected to the corresponding vertical support member and a front portion that extends between front ends of the opposing side portions; and a base member that is connected to bottom ends of the vertical support members, the base member pivoting relative to the vertical support members between an extended position and a retracted position, wherein the base member comprises opposing side portions each of which includes a rear end that is connected to the corresponding vertical support member and a front portion that extends between front ends of the opposing side portions;

wherein the rear end of each opposing side portion of the upper support member connects to the corresponding vertical support member via a corresponding top coupling member and the rear end of each opposing side portion of the base member connects to the corresponding vertical support member via a corresponding bottom coupling member;

wherein each top coupling member and each bottom coupling member comprises an inner plate and an outer plate.

2. The garbage bag holder of claim 1, wherein the rear end of each opposing side portion of the upper support member pivots between the inner plate and the outer plate of the corresponding top coupling member and the rear end of each opposing side portion of the base member pivots between the inner plate and the outer plate of the corresponding bottom coupling member.

3. The garbage bag holder of claim 2, wherein the side portions of the upper support member align with a horizontal top edge of the inner and outer plates of the corresponding top coupling member.

4. The garbage bag holder of claim 3, wherein the top ends of the vertical support members are spaced from the horizontal top edge of the inner and outer plates, and wherein the side portions of the upper support member contact the top ends of the vertical support members upon pivoting into the extended position.

5. The garbage bag holder of claim 3, wherein the inner and outer plates of each top coupling member are configured to receive and position a pin under and in contact with the corresponding side portion of the upper support member when the upper support member is in the extended position.

6. The garbage bag holder of claim 5, wherein the side portions of the base member align with a horizontal bottom edge of the inner and outer plates of the corresponding bottom coupling member.

7. The garbage bag holder of claim 6, wherein each side portion of the base member includes an extension that extends rearwardly beyond the corresponding vertical support member when the base member is in the extended position.

8. The garbage bag holder of claim 7, wherein the inner and outer plates of each bottom coupling member are configured to receive and position a pin above and adjacent to the corresponding side portion of the base member when the base member is in the extended position.

9. The garbage bag holder of claim 1, wherein the upper support member and the base member are perpendicular to the vertical support members when in the extended position and are parallel to the vertical support members when in the retracted position.

10. The garbage bag holder of claim 9, wherein the upper support member contacts the vertical support members to prevent the upper support member from pivoting beyond the extended position.

11. A garbage bag holder comprising:

opposing vertical support members;

an upper support member that is connected to top ends of the vertical support members, the upper support member pivoting relative to the vertical support members between an extended position and a retracted position; and a base member that is connected to bottom ends of the vertical support members, the base member pivoting relative to the vertical support members between an extended position and a retracted position;

wherein the base member extends frontwardly from the vertical support members when in the extended position and includes extensions that extend rearwardly beyond the vertical support members when in the extended position.

12. A garbage bag holder comprising:

opposing vertical support members;

an upper support member having opposing side portions and a front portion that extends between a front end of the opposing side portions of the upper support member, rear ends of the opposing side portions of the upper support member being connected to top ends of the vertical support members, the upper support member pivoting relative to the vertical support members between an extended position and a retracted position; and a base member having opposing side portions and a front portion that extends between a front end of the opposing side portions of the base member, rear ends of the opposing side portions of the base member being connected to bottom ends of the vertical support members, the base member pivoting relative to the vertical support members between an extended position and a retracted position;

wherein the opposing side portions of the base member include extensions that extend rearwardly beyond the vertical support members when the base member is in the extended position.

13. The garbage bag holder of claim 12, wherein the opposing side portions of the upper support member and the opposing side portions of the base member are parallel to the vertical support members when in the retracted position.

14. The garbage bag holder of claim 12, wherein the opposing side portions of the upper support member contact the vertical support members when pivoted into the extended position to thereby prevent the upper support arm from pivoting beyond the extended position.

15. The garbage bag holder of claim 12, wherein the rear ends of the opposing side portions of the upper support member connect to the top ends of the vertical support members via corresponding top coupling members and the rear ends of the opposing side portions of the base member connect to the bottom ends of the vertical support members via corresponding bottom coupling members.

16. The garbage bag holder of claim 15, wherein each top coupling member and each bottom coupling member comprises an inner plate and an outer plate.

17. The garbage bag holder of claim 16, wherein the opposing side portions of the upper support member align with a horizontal top edge of the inner and outer plates of the corresponding top coupling members.

18. The garbage bag holder of claim 17, wherein the top ends of the vertical support members are spaced from the horizontal top edge of the inner and outer plates, and wherein the opposing side portions of the upper support member contact the top ends of the vertical support members upon pivoting into the extended position.

19. The garbage bag holder of claim 16, wherein the opposing side portions of the base member align with a horizontal bottom edge of the inner and outer plates of the corresponding bottom coupling members.

20. The garbage bag holder of claim 16, wherein the inner and outer plates of each top coupling member are configured to receive and position a pin under and in contact with the corresponding opposing side portion of the upper support member when the upper support member is in the extended position, and wherein the inner and outer plates of each bottom coupling member are configured to receive and position a pin above and adjacent to the corresponding opposing side portion of the base member when the base member is in the extended position.

* * * * *